US006066429A

United States Patent [19]

Katoh

[11] Patent Number: 6,066,429

[45] Date of Patent: May 23, 2000

[54] TONER FOR DEVELOPMENT OF ELECTROSTATIC IMAGES

[75] Inventor: Kohichi Katoh, Kanagawa, Japan

[73] Assignee: Ricoh Company, Ltd., Tokyo, Japan

[21] Appl. No.: 09/097,812

[22] Filed: Jun. 16, 1998

[30] Foreign Application Priority Data

Jun. 16, 1997 [JP] Japan ..... 9-172779
Jun. 8, 1998 [JP] Japan ..... 10-173822

[51] Int. Cl.[7] ..... G03G 9/087

[52] U.S. Cl. ..... 430/109; 430/110; 430/111

[58] Field of Search ..... 430/109, 110, 430/111

[56] References Cited

U.S. PATENT DOCUMENTS

| | | | |
|---|---|---|---|
| 5,079,123 | 1/1992 | Nanya et al. | 430/110 |
| 5,244,765 | 9/1993 | Katoh et al. | 430/116 |
| 5,368,972 | 11/1994 | Yamashita et al. | 430/137 |
| 5,462,830 | 10/1995 | Kubota et al. | 430/110 |
| 5,773,510 | 6/1998 | Kazmaier et al. | 525/26 |

FOREIGN PATENT DOCUMENTS

| | | | |
|---|---|---|---|
| 1-288863 | 11/1989 | Japan | 430/109 |
| 2-217864 | 8/1990 | Japan | 430/109 |
| 6-19196 | 1/1994 | Japan . | |

OTHER PUBLICATIONS

Patent & Trademark Office English–Language Translation of JP 6–19196 (Pub Jan. 1994).
Caplus Abstract AN1991:111896 of JP 2–217864 (Pub Aug. 1990).
Derwent Abstract 90–308722/41 of JP 2–217864 (Pub Aug. 1990),. attached to JP 2–217864.
Caplus Abstract AN 1990:207900 of JP 1–288863 (Pub Nov. 1999).
Derwent Abstract 90–004767/01 of JP 1–288863 (Pub Nov. 1989), attatched to JP 1–288863.
Grant, R et al, ed. Grant & Hackh's Chemical Dictionary, Fifth Edition, McGraw–Hill Book Company, NY (1987) pp. 30, 31, 492, 494.

*Primary Examiner*—Janis L. Dote
*Attorney, Agent, or Firm*—Oblon, Spivak, McClelland, Maier & Neustadt, P.C.

[57] ABSTRACT

A toner for developing an electrostatic image to a visible toner image includes an amide-bonding-containing polymeric material, a releasing material, and a coloring agent, with the toner, when fused, having no interfaces between the toner particles thereof.

5 Claims, 1 Drawing Sheet

TONER FOR DEVELOPMENT OF ELECTROSTATIC IMAGES

BACKGROUND OF THE INVENTION

1. Field of the Invention

The present invention relates to a toner for developing latent electrostatic images formed by electrophotography, electrostatic recording method, or electrostatic printing method, to visible toner images.

2. Discussion of Background

Generally, in electrophotography and electrostatic printing, latent electrostatic images formed on an electrostatic image bearing member are developed to visible toner images, using a two-component toner comprising toner particles and carrier particles, or a mono-component toner comprising electrically charged toner particles, which are supplied in the form of a thin layer to the electrostatic image bearing member, using, for instance, a toner supply roller such as a development sleeve with a blade. When necessary, the developed toner images are transferred to a transfer sheet made of, for example, paper, and fixed thereon by the application heat and/or pressure thereto, or with the application of a vapor of a solvent, whereby image-bearing copies are obtained.

Of varieties of image fixing methods, which are suitable for the above-mentioned development methods, currently a heat roller image fixing method is widely used because of the advantages of higher thermal efficiency and higher image fixing speed over other image fixing methods.

When high speed image fixing is performed using the heat roller image fixing method, it is required that a toner for use in the image fixing method have excellent low-temperature image fixing performance, that is, a lower image fixing limit temperature of the toner is required to be significantly low. In order to attain this, if a resin which can be softened at a low temperature is added to the toner as a binder resin, at least part of toner images developed by the toner is apt to adhere to the surface of a heat roller in the course of the image fixing process. If this takes place, the toner which has adhered to the heat roller is then transferred to a copy paper, with the occurrence of the deposition of the toner on the background of the copy paper. Thus, a so-called hot offset phenomenon takes place. Furthermore, when the above-mentioned hot offset phenomenon takes place, the copy paper is apt to be wound around the heat roller. Thus, a so-called paper winding phenomenon is also apt to take place. This paper winding phenomenon is apt to take place particularly when the temperature of the heat roller is low. In the case of a color toner, when the above-mentioned hot offset phenomenon takes place, the glossiness of color images is significantly lowered. In addition, when the above-mentioned resin having a low softening temperature is added to the toner, toner particles thereof are apt to aggregate, and a so-called blocking phenomenon is apt to take place in the course of the transportation of the toner or while the toner is preserved in copying machine. Thus, the preservability of the toner is impaired.

In order to prevent the occurrence of the above-mentioned phenomena, in Japanese Laid-Open Patent Applications Nos. 51-143333, 57-148752, 58-97056 and 60-247250, it has been proposed to add as a releasing agent, solid silicone varnish, higher fatty acid, higher alcohol or wax to the toner. None of these releasing agents, however, exhibit satisfactory anti-hot offset performance and anti-paper-winding performance while maintaining excellent low-temperature image fixing performance.

Specifically, conventional polyolefin waxes such as low-molecular-weight polyethylene and polypropylene exhibit effective anti-hot-offset phenomenon but do not impart sufficient low-temperature image fixing performance to the toner for use in practice.

Vegetable waxes such as carnauba wax and candelilla wax exhibit effective anti-hot-offset phenomenon and low-temperature image fixing performance, but do not exhibit sufficient anti-paper-winding performance for use in practice. Solid silicone varnish, solid silicone oil, amide wax, higher fatty acid, higher alcohol and montan wax exhibit effective low-temperature image fixing performance, but do not exhibit sufficient anti-hot-offset performance and anti-paper-winding performance. Moreover, the use of such conventional releasing agents often causes a toner-filming phenomenon or a toner-spent phenomenon, in which the releasing agent is separated from the toner and adheres to the photoconductor and the surface of carrier particles for the toner. When such a phenomenon takes place, it is difficult to form high quality images continuously for an extended period of time.

In an attempt to lower the image-fixing temperature and to impart to the toner excellent anti-hot-offset performance and the anti-blocking performance, the following various proposals have been made by specifying the composition, thermal properties and molecular weight distribution of a binder resin for use in the toner:

For example, Japanese Laid-Open Patent Application 3-139663 proposes to specify a binder resin with a softening temperature thereof; Japanese Laid-Open Patent Application 3-152558 proposes to specify a binder resin with a molecular weight distribution thereof: Japanese Laid-Open Patent Application 3-145654 proposes to specify a cross linking agent for use in a binder resin; Japanese Laid-Open Patent Application 3-206465 proposes to specify the production of a binder resin using a block polymer; Japanese Laid-Open Patent Application 3-219262 proposes to specify a binder resin with the viscoelastic properties thereof; Japanese Laid-Open Patent Application 3-188468 proposes to specify a binder resin with an acid value/a hydroxyl group value thereof; Japanese Laid-Open Patent Applications 3-203748 and 3-229264 propose to specify a polyester with an acid value thereof; Japanese Laid-Open Patent Applications 3-231757, 4-353866 and 5-100477 propose to specify binder resins with the viscoelastic properties thereof; Japanese Laid-Open Patent Applications Nos. 4-20512, 4-23816, 4-23817 and 4-50216 propose to specify a binder resin as a styrene-acrylic block copolymer; Japanese Laid-Open Patent Applications Nos. 4-26858, 4-81769 and 4-81770 propose to specify a binder resin as a block or graft copolymer of a crystalline polyester and a vinyl copolymer; Japanese Laid-Open Applications 4-81863 and 6-348058 propose to specify a binder resin with a peak of a molecular weight thereof; Japanese Laid-Open Application 4-190242 proposes to specify a toner with a molecular weight distribution of a binder resin and an image fixing method for use with the toner; Japanese Laid-Open Application 4-254863 proposes to specify binder resins as a polyester and a styrene/acrylic polymer with particular molecular weights thereof; Japanese Laid-Open Patent Applications 4-264559, 4- 264560, 4-274253, 5-19531 and 5-188638 propose to specify a binder resin with a molecular weight distribution thereof; Japanese Laid-Open Patent Application 4-277755 proposes to specify a binder resin as a particular block copolymer; and Japanese Laid-Open Patent Application 4-309962 proposes to specify a binder resin by the use of an ionomer.

The above-proposed binder resins, however, are not satisfactory.

Japanese Laid-Open Patent Application 60-31146 proposes a photodegradation capsuled toner; Japanese Laid-Open Patent Application 62-148969 proposes a toner using an exothermic amplification material; Japanese Laid-Open Patent Application 63-281168 proposes a capsuled toner having a thermotropic liquid crystal polymeric shell; Japanese Laid-Open Patent Application 1-149062 proposes a capsuled toner of which volume can be expanded when exposed to light; Japanese Laid-Open Patent Application 2-251971 proposes a toner using a cross-linking thermotropic liquid crystal polymer; Japanese Laid-Open Patent Application 3-118550 proposes a toner comprising an exothermic material; Japanese Laid-Open Patent Application 4-250460 proposes a toner comprising an cyclohexanone derivative; Japanese Laid-Open Patent Application 4-291355 proposes a toner comprising a Bisphenol F-type epoxy resin; Japanese Laid-Open Patent Application 4-329551 proposes a toner comprising a near infrared absorption pigment and an ethylenic unsaturated compound which is cured when exposed to near infrared rays; Japanese Laid-Open Patent Application 4-100475 and Japanese Laid-Open Patent Application 4-100476 propose a toner comprising a heat decomposable resin using an azo polymerization initiator; Japanese Laid-Open Patent Application 5-173364 proposes a toner comprising a cyclohexanone-based ketone resin; Japanese Laid-Open Patent Application 8-15894 proposes a toner prepared using a polymer with an acid value or a hydroxyl group value of 1 or more, with the deposition of a metal alkoxide on the surface of the toner; and Japanese Laid-Open Patent Application 8-15902 proposes a capsuled toner prepared by using a chlorine-containing monomer in the capsule thereof.

The above-proposed toners, however, are not satisfactory for use in practice.

The inventor of the present invention proposed the use of a star polymer as a binder resin for a toner in Japanese Laid-Open Patent Application 7-261457. However, the resolution of images obtained by the toner is not satisfactory. Furthermore, the star polymer used as the binder resin basically has charging properties, but the charging performance thereof is not stable enough with time and not satisfactory for use in practice.

SUMMARY OF THE INVENTION

It is therefore an object of the present invention to provide a toner for developing latent electrostatic images, which is capable of performing low-temperature image fixing which is suitable for energy saving, and preventing the occurrence of the hot-offset phenomenon and the paper-winding phenomenon, with stable charging performance and excellent preservability for an extended period of time, and also capable of forming images with high resolution.

The object of the present invention can be achieved by a toner comprising toner particles for developing an electrostatic image to a visible toner image, which comprises an amide-bond-containing polymeric material, a releasing material, and a coloring agent, with the toner particles, when fused, having no interfaces therebetween.

It is preferable that the above-mentioned amide-bond-containing polymeric material for the toner be a star polymer.

It is preferable that the star polymer for use in the present invention comprise a core moiety of the following formula:

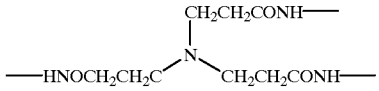

It is also preferable that the above-mentioned amide-bond-containing polymeric material have an entanglement molecular weight of 15,000 or less, preferably in a range of 1,000 to 15,000.

It is also preferable that the above toner have a glass transition point in a range of 60° C. to 90° C.

It is also preferable that the releasing material for the above toner comprise carnauba wax.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The conventional toner has the problem of the occurrence of the hot offset phenomenon as discussed above.

Figure 1:
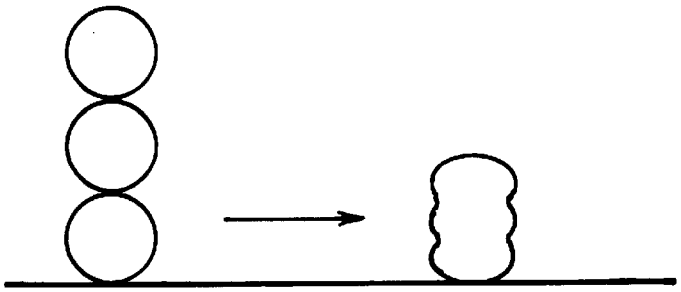
FIG. 1 is a schematic diagram in explanation of an image fixing process when a toner of the present invention is used.
Figure 2:
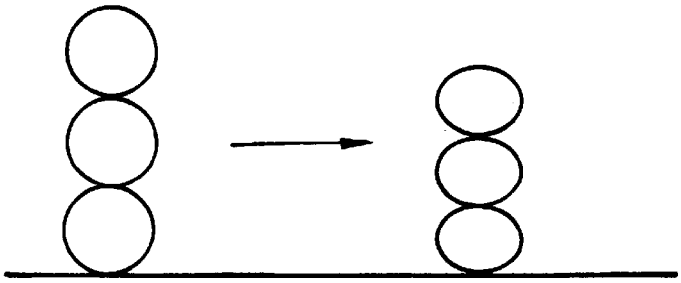
FIG. 2 PRIOR ART
FIG. 2 a schematic diagram in explanation of an image fixing process when a conventional toner is used.

When the conventional toner is subjected to the low-temperature fixing process, it is considered that heat is not sufficiently transferred from an image fixing roller to the toner, particularly in the case of a halftone image, so that as illustrated in FIG. 2, the particles of the toner are not mutually fused, with the formation of interfaces between the toner particles at the time of the image fixing.

Since the conventional toner has the problem of the hot-offset, a sufficient amount of thermal energy cannot be applied to the toner for the image fixing and therefore the fixed image does not necessarily have a sufficient image fixing strength for use in practice. An inspection by a transmission-type electron microscope of the image fixed state attained by the conventional toner indicates that there exist interfaces between the toner particles even when the toner particles are fused for image fixing.

In view of the above-mentioned facts and through various studies, the inventor of the present invention has discovered that a toner which is free of the above-mentioned interfaces between the fused toner particles has no hot-offset problem even when subjected to the low-temperature image fixing using an image fixing roller.

The toner of the present invention in a fused state was subjected to the above-mentioned interface analysis of the toner particles by a transmission-type electron microscope and also to an image formation analysis. The result was that the toner particles were in a mutually fused state, but without interfaces therebetween.

Furthermore, the inventor of the present invention has discovered that when an amide-bond-containing polymeric material, preferably an amide-bond-containing star polymer, is used as a binder resin for the toner, images with high resolution can be obtained. When such an amide-bond-containing binder polymer is used, the molecules thereof are likely to entangle themselves, rather than form an aggregation structure, so that it is easy to control the molecular weight of the binder polymer so as to obtain images with high resolution when used in the toner.

[Inspection of Interfaces in Fused Toner

The presence or absence of the interfaces between the toner particles, when fused, is inspected as follows:

Teflon was coated with a thickness of 20 $\mu$m on a 20 mm×75 mm aluminum plate with a thickness of 3 mm to prepare a Teflon-coated aluminum substrate, which was composed of a Teflon-coated layer and the aluminum plate.

A plain paper strip with the same size as that of the above prepared Teflon-coated substrate was cut out of a commercially available plain paper (Trademark "TYPE 6200" made by Ricoh Company, Ltd.) to prepare a plain paper strip base.

0.01 g of a sample toner was uniformly deposited on the plain paper strip base in an area of 20 mm×20 mm thereof to prepare a sample toner-deposited paper strip.

The sample toner-deposited paper strip was superimposed on the Teflon-coated aluminum substrate in such a manner that the toner layer came into contact with the Teflon-coated layer of the Teflon-coated aluminum substrate.

A 20 mm×75 mm aluminum plate with a thickness of 3 mm was then placed on the plain paper base side of the toner-deposited paper strip as a support, whereby a test sample for image fixing was prepared, which was composed of the aluminum plate serving as the support, the plain paper base, the toner layer, the Teflon-coated layer, and the aluminum plate in this order.

This test sample was placed in a hot press apparatus so as to be held between an upper holding member and a lower holding member in such a manner that the aluminum plate serving as the support came into contact with the lower holding member, and the aluminum plate for the Teflon-coated aluminum substrate came into contact with the upper holding member under the conditions that the temperature of the aluminum plate for the Teflon-coated aluminum substrate in contact with the upper holding member was set at 180° C., and the temperature of the lower holding member in contact with the aluminum plate serving as the support was set at 100° C., with the application of a pressure of 2 kgf/cm$^2$ across the upper holding member and the lower holding member for 100 msec.

After the heating and the pressure application process, the toner layer fixed to the plain paper was peeled away from the Teflon-coated layer of the Teflon-coated aluminum substrate.

The toner layer fixed to the plain paper was sliced and a cross-section of the sliced toner layer was inspected, using a transmission-type electron microscope and an image analysis software, "NIH Image", to observe the deformed state of toner particles in the cross-section and to subject the same to a binary image analysis for the analysis of the external shape of the fixed toner particles.

In the above analysis conducted, there are reproduced the conditions under which toner particles are fixed to an image receiving material such a plain paper, so that when the toner particles are thermally deformed and deposited on the paper, there can be observed various interfaces of the toner particles covering the indication of the original shape to considerably deformed shapes having no trace of the original shape. On the other hand, when proper image fixing is performed, the individual toner particles are fused without any trace of the original shape and any interfaces therebetween.

The inventor of the present invention has further discovered that when the polymeric material serving as the binder polymer for the toner has an entanglement molecular weight in the range of 1,000 to 15,000, the anti-hot offset performance of the toner is significantly improved.

Figure 3:
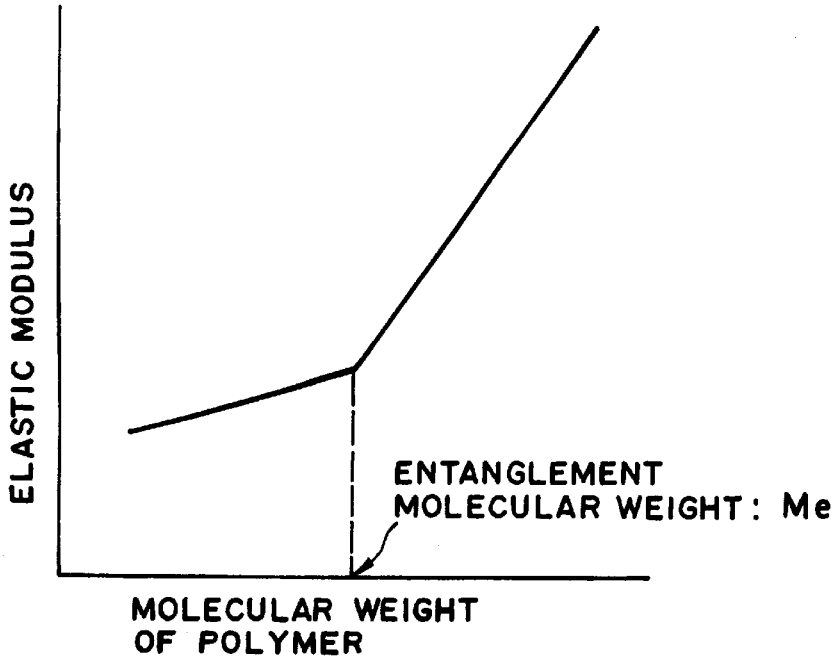
FIG. 3 is a graph showing the relationship between a molecular weight of a polymer and a viscosity of the polymer in explanation of a definition of an entanglement molecular weight of the polymer.

The entanglement molecular weight (Me) of polymer is defined by the following formula (I):

$$Me=\rho RT/G_N^{\circ} \quad (I)$$

wherein ρ is density, R is gas constant, T is temperature, and $G_N^{\circ}$ is quasi-equilibrium elastic coefficient. The quasi-equilibrium elastic coefficient means a rubber elastic area of a polymer. When the entanglement molecular weight (Me) is decreased, the rubber elastic area can be increased. The elastic modulus of a polymer changes so as to become molecular-weight-dependent from a particular molecular weight on and the relationship between the molecular weight and the elastic modulus is as shown in a graph in FIG. 3, in which the molecular weight corresponding to a bending point of the change is referred to as the entanglement molecular weight.

The inventor of the present invention has further discovered that the preservability of the toner at high temperatures can be improved when the toner has a glass transition point in a range of 60° C. to 90° C.

The toner of the present invention comprises the amide-bond-containing polymeric material, a releasing material and a coloring agent.

Any amide-bond-containing polymeric material can be used in the toner of the present invention so long as the toner does not form any interface in the particles thereof when fused and fixed. The following polymeric materials are particularly preferable for use in the toner of the present invention:

Star polymers such as amide-bond-containing styrene based star polymers, amide-bond-containing olefin based star polymers, amide-bond-containing polyester based star polymers, amide-bond-containing polybutadiene based star polymers, amide-bond-containing fluorine plastic based star polymer, and amide-bond-containing polyvinyl ethers.

The above-mentioned star polymers can be prepared, for example, in accordance with the reaction scheme (I):

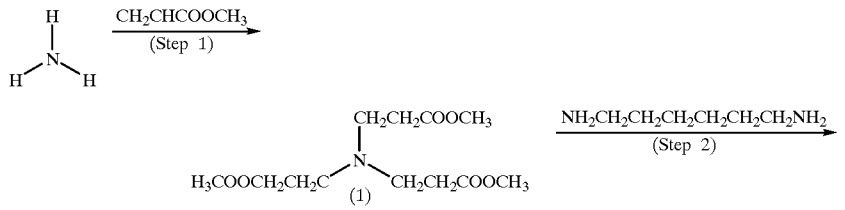

-continued

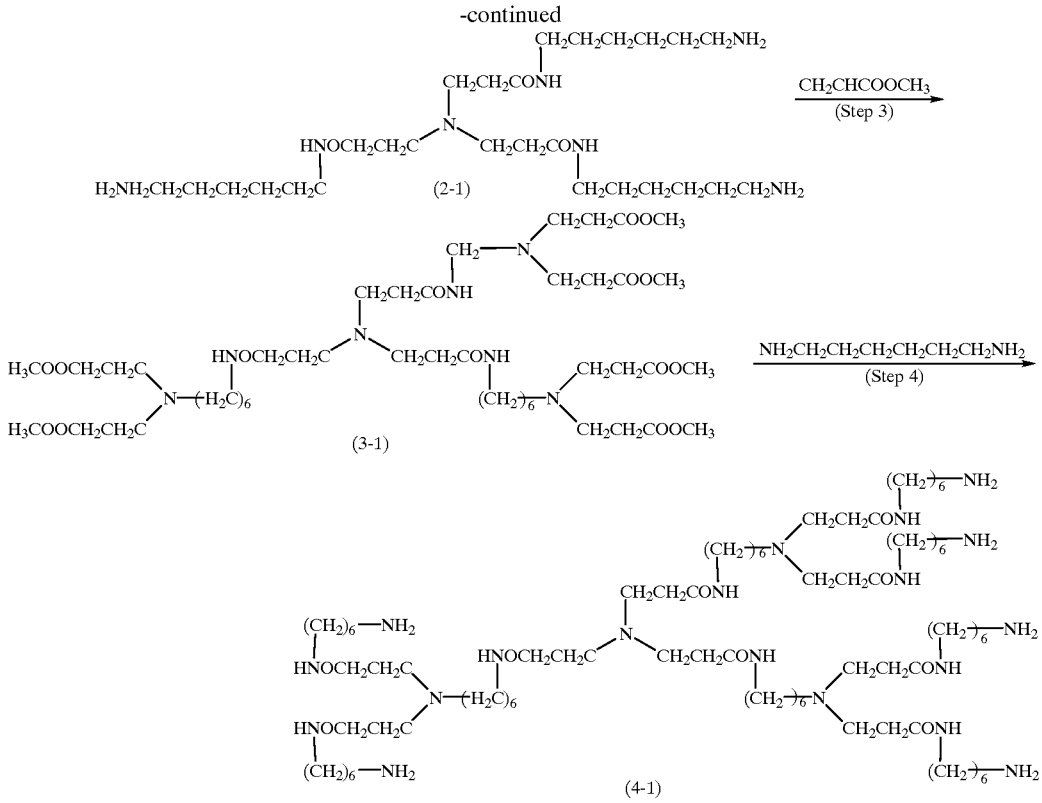

Three moles of methyl acrylate are added to 1 mole of ammonia so as to be subjected to Michael addition reaction, whereby a terminal-methyl-ester moiety containing compound (1) is synthesized in Step 1.

3 moles of 1,6-hexanediamine are then added to 1 mole of the compound (1) so as to allow the two compounds to react, whereby a three-amino-group-containing amide amine (2-1) is synthesized in Step 2.

Methyl acrylate is then allowed to react with the terminal amino groups of the amide amine (2-1) so as to be subjected to Michael addition reactions whereby a compound (3-1) is obtained in Step 3.

6 moles of 1,6-hexanediamine are added to 1 mole of the compound (3-1) so as to allow the two compounds to react, whereby a six-amino-group-containing amide amine (4-1) is obtained in Step 4.

By modifying the terminal amino groups, star polymers having polymeric chains with any length can be obtained as desired. By repeating the above reaction, the number of branched chains can be changed as desired. It is preferable that the number of branched chains for such star polymer be not more than 20 in order to obtain preferable elasticity without having the branched chains remains elongated so as to lose elasticity and making inactive the interaction between the polymer molecules.

Specific examples of monomers for preparing the polymeric material serving as a binder polymer for the toner of the present invention are as follows: styrene and styrene derivatives such as o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene and 3,4-dichlorostyrene; ethylene and ethylenic unsaturated monoolefins such as propylene, butylene and isobutylere; halogenated vinyls such as vinyl chloride, vinylidene chloride, vinyl bromide and vinyl fluoride; vinyl esters such as vinyl acetate and vinyl propionate; α-methylene aliphatic monocarboxylic acid esters such as methyl acrylate, ethyl acrylate, n-butyl acrylate, methyl methacrylate, ethyl methacrylate and trifluoroethyl acrylate, hexafluoroisopropyl acrylate, tetrafluoropropyl acrylate, octafluoropentyl acrylate, and heptadecafluorodecyl acrylate; vinyl ethers such as vinyl methyl ether; vinylketones such as vinyl methyl ketone; and N-vinyl compounds such as N-vinylpyrrole, N-vinylcarbazole, N-vinylindole and N-vinylpyrrolidone. These monomers can be used alone or in combination.

Specific examples of the releasing material for use in the toner of the present invention are vegetable waxes such as carnauba wax, rice wax, Japan wax, and candelilla wax; animal waxes such as lanolin, bees wax, spermaceti, and shellac wax; mineral waxes such as montan wax, ozocerite, and ceresine wax; petroleum waxes such as polyethylene wax, polypropylene wax, paraffin wax, and microcrystalline wax; synthetic hydrocarbons such as low-molecular-weight polyethylene; higher fatty acids; higher fatty acid esters; higher fatty acid amides such as ricinoleamide, lauramide, erucamide, palmitamide, oleamide, stearamide, higher fatty acid metallic salts, such as sodium stearate, sodium palmitate, aluminum stearate, zinc stearate, potassium laurate and potassium myristate. Of these releasing materials, carnauba wax is most preferably employed because carnauba wax is capable of being fused at low temperatures with a narrow fusion temperature range, quickly spreading at the interface between the toner particles and the fixing roller when fused, and therefore suitable for the improvement of image resolution.

In the toner of the present invention, there can be contained additives such as a coloring agent and a charge controlling agent.

Specific examples of coloring agents for use in the present invention include carbon black, Oil Black, nigrosine dyes, metal chelate dyes such as metal-containing dyes, aniline dyes, Chalco Oil Blue, chrome yellow, ultramarine blue, methylene blue chloride, phthalocyanine blue, Rose Bengale, and other conventional dyes and pigments.

Furthermore, the toner of the present invention may comprise a fluidity-promoting agent. Examples of fluidity-promoting agents are inorganic oxides such as $SiO_2$ and $TiO_2$, with hydrophobic surface treatment; finely-divided inorganic particles, such as finely-divided particles of SiC; and metallic soap such as zinc stearate.

It is preferable that the toner of the present invention comprise the amide-bond-containing polymeric material serving as a binder resin in an amount of 75 to 93 wt. %, the coloring agent in an amount of 3 to 10 wt. %, the releasing material in an amount of 3 to 8 wt. % and other components in an amount of 1 to 7 wt. % to the total amount by weight of the toner.

The toner of the present invention can be employed as a mono-component developer or in combination of a carrier as a two-component developer.

As the carrier for use in the above, any conventional carrier such as iron powder, ferrite and glass beads can be employed. The surface of the carrier particles of such carrier may be coated with a resin such as polyfluorocarbon, polyvinyl chloride, polyvinylidene chloride, phenolic type resin, polyvinyl acetal, or silicone resin. It is preferable that the mixing ratio of the toner to the carrier be in a range of 0.5 to 6.0 parts by weight of the toner to 100 parts by weight of the carrier.

Other features of this invention will become apparent in the course of the following description of exemplary embodiments, which are given for illustration of the invention and are not intended to be limiting thereof.

EXAMPLE 1

Synthesis of Amide-Bond-Containing Star Polymer No. 1

In accordance with the above-mentioned reaction scheme (I), 3 moles of methyl acrylate were added to 1 mole of ammonia to be subjected to Michael addition reaction, whereby a terminal-methyl-ester moiety-containing compound (1) was synthesized in Step 1.

3 moles of 1,6-hexanediamine were added to 1 mole of the above compound (1) so as to allow the two compounds to react, whereby a three-amino-group-containing amide amine (2-1) was obtained in Step 2.

Methyl acrylate was then allowed to react with the terminal amino groups of the amide amine (2-1) to be subjected to Michael addition reaction, whereby a compound (3-1) was obtained in Step 3.

6 moles of 1,6-hexanediamine were added to 1 mole of the above compound (3-1) so as to allow the two compounds to react, whereby a six-amino-group-containing amide amine (4-1) was obtained in Step 4.

With the addition of a block polymer of styrene and methyl methacrylate having p-methylene chloride styrene at a terminal of the block polymer obtained by anionic polymerization, to the terminal amino groups of the amide amine (4-1), an amide-bond-containing star polymer No. 1 was prepared.

The above amide-bond-containing star polymer No. 1 is in the shape of a star polymer and includes a core moiety from which six polymer branched chains extend, and has an entanglement molecular weight of 17,000 and a glass transition temperature of 92° C.

Preparation of Toner No. 1 of the Present Invention

The following components were mixed and kneaded under the application of heat thereto:

| | Parts by Weight |
|---|---|
| Binder resin: the above prepared amide-bond-containing star polymer No. 1 | 90 |
| Releasing agent: polypropylene wax | 10 |
| Coloring agent: carbon black | 10 |
| Charge controlling agent: zinc salt of salicylic acid derivative | 6 |

The above mixture was cooled and then roughly ground in a hammer mill and then finely pulverized in an air-jet type pulverizer. The thus pulverized particles were classified, so that toner particles with an average particle diameter of 7.3 $\mu$m were prepared.

1.5 parts by weight of finely-divided silica particles were added to 100 parts by weight of the above-prepared toner particles, whereby toner No. 1 of the present invention was prepared.

EXAMPLE 2

Synthesis of Amide-bond-containing Star Polymer No. 2

In accordance with the above-mentioned reaction scheme (I), 3 moles of methyl acrylate were added to 1 mole of ammonia to be subjected to Michael addition reaction, whereby the same terminal-methyl-ester moiety containing compound (1) as prepared in Example 1 was synthesized in Step 1.

3 moles of 1,6-hexanediamine were added to 1 mole of the above compound (1) so as to allow the two compounds to react, whereby the same three-amino-group-containing amide amine (2-1) as prepared in Example 2 was obtained in Step 2.

With the addition of a polystyrene having p-methylene chloride styrene at a terminal thereof obtained by anionic polymerization, to the terminal amino groups of the amide amine (2-1), an amide-bond-containing star polymer No. 2 was prepared.

The above obtained amide-bond-containing star polymer No. 2 is in the shape of a star polymer and includes a core moiety from which three polymer branched chains extend, and has an entanglement molecular weight of 14,000 and a glass transition temperature of 95° C.

Preparation of Toner No. 2 of the Present Invention

The following components were mixed and kneaded under the application of heat thereto:

| | Parts by Weight |
|---|---|
| Binder resin: the above prepared amide-bond-containing star polymer No. 2 | 95 |
| Releasing agent: polyethylene wax | 5 |
| Coloring agent: carbon black | 10 |
| Charge controlling agent: zinc salt of salicylic acid derivative | 5 |

The above mixture was cooled and then roughly ground in a hammer mill and then finely pulverized in an air-jet type pulverizer. The thus pulverized particles were classified, so that toner particles with an average particle diameter of 6.4 μm were prepared.

1.3 parts by weight of finely-divided silica particles were added to 100 parts by weight of the above-prepared toner particles, whereby toner No. 2 of the present invention was obtained.

EXAMPLE 3

Synthesis of Amide-bond-containing Star Polymer No. 3

Reaction Scheme (II)

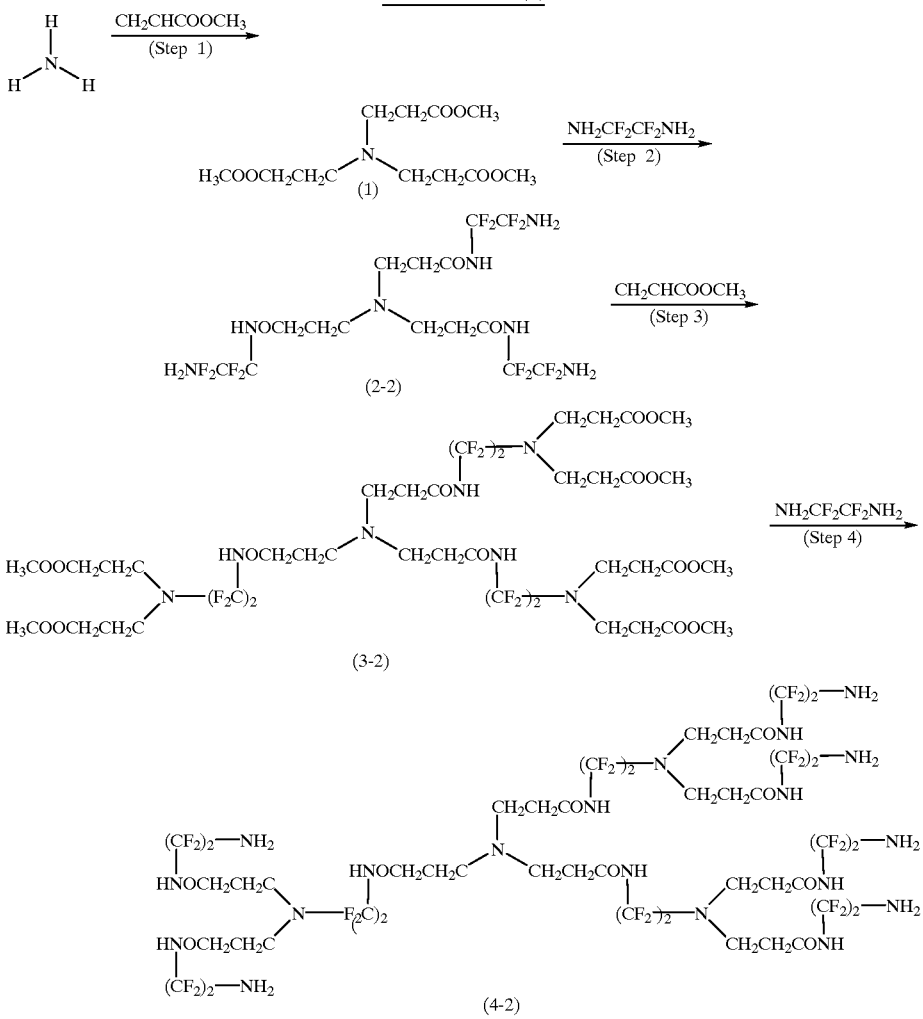

In accordance with the above-mentioned reaction scheme (II), 3 moles of methyl acrylate were added to 1 moles of ammonia so as to be subjected to Michael addition reaction, whereby the same terminal-methyl-ester moiety containing compound (1) as prepared in Example 1 was synthesized in Step 1.

3 moles of 1,2-tetrafluoroethylenediamine were added to 1 mole of the above compound (1) so as to allow the two compounds to react, whereby a three-amino-group-containing amide amine (2-2) was obtained.

Methyl acrylate was then allowed to react with the terminal amino groups of the above amide amine (2-2) so as to be subjected to Michael addition reaction, whereby a compound (3-2) was obtained.

6 moles of 1,2-tetrafluoroethylenediamine were further added to 1 mole of the above compound (3-2) so as to allow the two compounds to react, whereby a six-amino-group-containing amide amine (4-2) was obtained.

With the addition of a block polymer of styrene and methyl methacrylate having p-methylene chloride styrene at a terminal of the block polymer obtained by anionic polymerization, to the terminal amino groups of the amide amine (4-2), an amide-bond-containing star polymer No. 3 was prepared.

The above prepared amide-bond-containing star polymer No. 3 is in the shape of a star polymer and includes a core moiety from which six polymer branched chains extend, and has an entanglement molecular weight of 17,000 and a glass transition temperature of 59° C.

Preparation of Toner No. 3 of the Present Invention

The following components were mixed and kneaded under the application of heat thereto:

| | Parts by Weight |
|---|---|
| Binder resins: styrene-methacrylic acid copolymer | 20 |
| the above prepared amide-bond-containing star polymer No. 3 | 50 |
| Polyester copolymer | 25 |
| Releasing agent: carnauba wax | 5 |
| Coloring agent: carbon black | 10 |

The above mixture was cooled and then roughly ground in a hammer mill and then finely pulverized in an air-jet type pulverizer. The thus pulverized particles were classified, so that toner particles with an average particle diameter of 8.8 μm were prepared.

1.4 parts by weight of finely-divided silica particles were added to 100 parts by weight of the above-prepared toner particles, whereby toner No. 3 of the present invention was prepared.

EXAMPLE 4

In accordance with the same reaction scheme (II) as in Example 3, the six-amino-group-containing amide amine (4-2) as prepared in Example 3 was prepared.

With the addition of a block polymer of styrene and methyl methacrylate having p-methylene chloride styrene at a terminal of the block polymer, which was obtained by anionic polymerization, but not in the same manner as in Example 3, to the terminal amino groups of the amide amine (4), an amide-bond-containing star polymer No. 4 was prepared.

The above prepared amide-bond-containing star polymer No. 4 is in the shape of a star polymer and includes a core moiety from which six polymer branched chains extend, and has an entanglement molecular weight of 12,000 and a glass transition temperature of 69° C.

Preparation of Toner No. 4 of the Present Invention

The following components were mixed and kneaded under application of heat thereto;

| | Parts by Weight |
|---|---|
| Binder resins: styrene-methacrylic acid copolymer | 20 |
| the above prepared amide-bond-containing star polymer No. 4 | 50 |
| Polyester copolymer | 25 |
| Releasing agent: polypropylene wax | 5 |
| Coloring agent: carbon black | 10 |
| Charge controlling agent: zinc salt of salicylic acid derivative | 6 |

The above mixture was cooled and then roughly ground in a hammer mill and then finely pulverized in an air-jet type pulverizer. The thus pulverized particles were classified, so that toner particles wish an average particle diameter of 8.8 μm were prepared.

1.4 parts by weight of finely-divided silica particles were added to 100 parts by weight of the above-prepared toner particles, so that toner No. 5 of the present invention was prepared.

COMPARATIVE EXAMPLE 1

Preparation of Comparative Toner No. 1

The procedure for preparation of toner No. 1 in Example 1 was repeated except that the amide-bond-containing star polymer No. 1 used in Example 1 was replaced by a styrene-acrylic acid copolymer, whereby comparative toner No. 1 was prepared.

COMPARATIVE EXAMPLE 2

Preparation of Comparative Toner No. 2

The procedure for preparation of toner No. 2 in Example 2 was repeated except that the amide-bond-containing styrene-acrylic star polymer No. 2 used in Example 2 was replaced by a styrene-methacrylic acid copolymer, whereby comparative toner No. 2 was prepared.

The above prepared toners No. 1 to No. 4 of the present invention and comparative toners No. 1 and No. 2 were subjected to the above-mentioned interface inspection under a fused state.

The result was that no interfaces were observed in toners No. 1 to No. 5 of the present invention, while interfaces were observed in the above-prepared comparative toners No. 1 and No. 2.

APPLICATION EXAMPLE 1

5 parts by weight of toner No. 1 prepared in Example 1 and 95 parts by weight of a ferrite carrier were mixed, whereby a developer No. 1 was prepared.

The thus prepared developer No. 1 was evaluated, using a commercially available copying machine (Trademark "FT-8200" made by Ricoh Company, Ltd.) with respect to the following evaluation points by the following methods and evaluation standards:

(1) Anti-hot-offset Performance 100,000 copies were made by using developer No. 1 and the above-mentioned copying machine, and the occurrence of the hot offset phenomenon was visually inspected in the next copy made.

oo: no occurrence o: almost no occurrence (almost invisible)

Δ: observed from place to place x: observed in entire images (2) Charge Quantity (Q/M)

The charge quantity of toner No. 1 in developer No. 1 before use, which is referred to the initial charge quantity (Q/M), and the charge quantity thereof after making 10,000 copies were measured.

(3) Image Resolution

Immediately after image formation, the resolution was visually inspected.

oo: Excellent o: Good

Δ: Poor x: Extremely poor (4) Preservability

Developer No. 1 was preserved at 50° C. for 3 hours and the occurrence of the blocking of the developer was visually inspected.

oo: no occurrence o: almost no occurrence (almost invisible)

Δ: occurred from place to place x: completely occurred

The results of the above evaluations are shown in TABLE 1.

APPLICATION EXAMPLES 2 TO 4 AND COMPARATIVE APPLICATION EXAMPLES 1 AND 2

5 parts by weight of each of toners No. 2 to No. 5 prepared in Examples 2 to 4 and comparative toners No. 1 and No. 2 prepared in Comparative Examples 1 and 2, and 95 parts by weight of the ferrite carrier were separately mixed, whereby developers No. 2 to No. 4 and comparative developers No. 1 and No. 2 were prepared.

The thus prepared developers No. 2 to No. 4 and comparative developers No. 1 and No. 2 were evaluated in the same manner as in Example, using the same commercially available copying machine (Trademark "FT-8200" made by Ricoh Company, Ltd.) as used in Example 1, with respect to the same evaluation points.

The results are shown in TABLE 1.

TABLE 1

| | Developer | Image Fixing Temperature (° C.) | Anti-Hot-Offset Performance | Charge Quantity Q/M (Initial) | Charge Quantity Q/M (after making 10,000 copies) | Resolution | Preserv-ability |
|---|---|---|---|---|---|---|---|
| Application Ex. 1 | 1 | 140 | ○ | 20.5 | 18.0 | ○ | ○ |
| Application Ex. 2 | 2 | 150 | ○○ | 22.3 | 21.1 | ○ | ○ |
| Application Ex. 3 | 3 | 150 | ○ | 25.8 | 22.6 | ○○ | ○○ |
| Application Ex. 4 | 4 | 150 | ○○ | 21.7 | 20.4 | ○ | ○○ |
| Comparative Application Ex. 1 | Comp. 1 | 170 | x | 27.0 | 15.3 | Δ | Δ |
| Comparative Application Ex. 2 | Comp. 2 | 170 | Δ | 18.2 | 14.9 | Δ | Δ |

Japanese Patent Application No. 9-172779 filed Jun. 16, 1997 and Japanese Patent Application filed Jun. 8, 1998 are hereby incorporated by reference.

What is claimed is:

1. A toner comprising toner particles for developing an electrostatic image to a visible toner image, comprising:

a star polymer having a core moiety of formula:

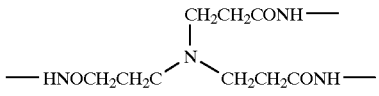

a releasing material, and a coloring agent, with said toner particles, when fused, having no interfaces therebetween.

2. The toner as claimed in claim 1, wherein said star polymer has an entanglement molecular weight in a range of 1,000 to 15,000.

3. The toner as claimed in claim 1, wherein said star polymer has an entanglement molecular weight in a range of 1,000 to 15,000.

4. The toner as claimed in claim 1, wherein the toner particles have a glass transition point in the range of 60° C. to 90° C.

5. The toner as claimed in claim 1, wherein said releasing material comprises carnauba wax.

* * * * *

UNITED STATES PATENT AND TRADEMARK OFFICE

CERTIFICATE OF CORRECTION

PATENT NO. : 6,066,429
DATED : May 23, 2000
INVENTOR(S) : Kohichi Katoh

It is certified that error appears in the above-identified patent and that said Letters Patent is hereby corrected as shown below:

Column 7,
Formula (3-1),

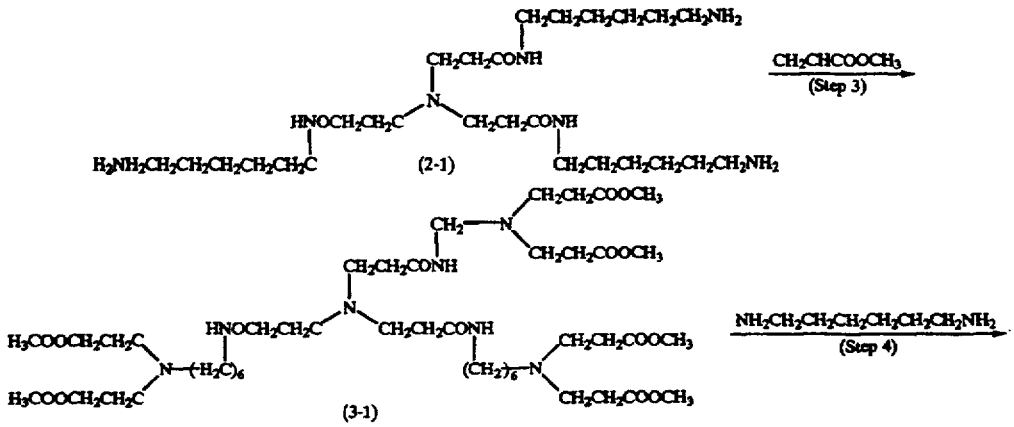

should read --

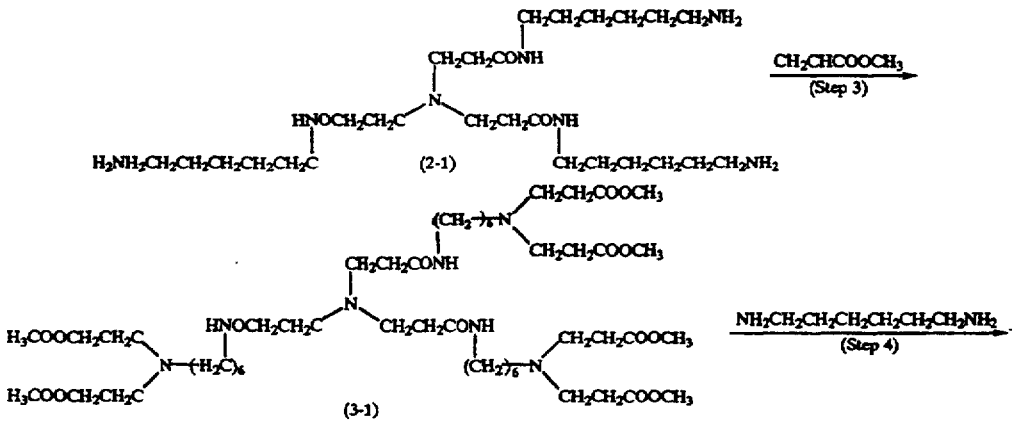

UNITED STATES PATENT AND TRADEMARK OFFICE

CERTIFICATE OF CORRECTION

PATENT NO. : 6,066,429
DATED : May 23, 2000
INVENTOR(S) : Kohichi Katoh

It is certified that error appears in the above-identified patent and that said Letters Patent is hereby corrected as shown below:

Column 8,
Line 37, reads "isobutylere" should read -- isobutylene --.

Signed and Sealed this

Twenty-fifth Day of December, 2001

*Attest:*

*Attesting Officer*

JAMES E. ROGAN
*Director of the United States Patent and Trademark Office*